United States Patent [19]

Rombout

[11] Patent Number: 4,697,516

[45] Date of Patent: Oct. 6, 1987

[54] MOUNTING MEANS FOR PLATE CYLINDERS OF A PRINTING MACHINE HAVING REPLACEABLE SLEEVELIKE PLATE CYLINDER SHELLS

[75] Inventor: Anton Rombout, Oosterbeek, Netherlands

[73] Assignee: Windmöller & Hölscher, Lengerich, Fed. Rep. of Germany

[21] Appl. No.: 804,434

[22] Filed: Dec. 4, 1985

[30] Foreign Application Priority Data

Dec. 4, 1984 [DE] Fed. Rep. of Germany ..... 3444192
Jan. 7, 1985 [DE] Fed. Rep. of Germany ..... 3500319

[51] Int. Cl.[4] ..... B41F 13/10; B41F 13/20
[52] U.S. Cl. ..... 101/216; 101/375
[58] Field of Search ..... 101/375, 376, 216, 212, 101/152, 153, 178

[56] References Cited

U.S. PATENT DOCUMENTS

| | | | |
|---|---|---|---|
| 2,460,504 | 2/1949 | Huebner | 101/216 |
| 2,790,384 | 4/1957 | Kaldschmidt | 101/216 |
| 2,925,037 | 2/1960 | Fischer | 101/216 |
| 3,789,757 | 2/1974 | Motter | 101/216 |
| 4,119,032 | 10/1978 | Hollis | 101/375 X |

FOREIGN PATENT DOCUMENTS

| | | | |
|---|---|---|---|
| 891396 | 8/1953 | Fed. Rep. of Germany | 101/216 |
| 1292957 | 4/1969 | Fed. Rep. of Germany | 101/375 |

*Primary Examiner*—J. Reed Fisher
*Attorney, Agent, or Firm*—Fleit, Jacobson, Cohn & Price

[57] ABSTRACT

Apparatus for rotatably mounting plate cylinders on a printing machine, such as a flexographic printing machine, that includes removable sleevelike plate cylinder shells, and for facilitating installation and removal of the cylinder shells. During replacement of each plate cylinder shell, one journal of the plate cylinder core is supported by the frame of the printing machine. The other bearing support is withdrawable from the other journal and includes a bearing support bracket that is axially displaceable relative to the axis of the plate cylinder by a carriage carried on tracks that have ends secured to a pivotable yoke to permit the other bearing support to be axially withdrawn from the plate cylinder journal and to pivot outwardly. The tracks are adapted to be locked at their inner ends to the machine frame or to the plate cylinder carriage. The pivotable yoke and the tracks for the bearing bracket constitute the end structure of the plate cylinder carriage on one side thereof and permit quick removal of the plate cylinder shell. Hydraulic piston-cylinder units are provided on both sides of the bearing support which is not withdrawn for supporting the plate cylinder core, and are mounted on the machine frame or on the plate cylinder carriage. The respective piston-cylinder units counterbalance the pivot moment of the plate cylinder to support it when the opposite bearing is removed to permit removal or installation of a plate cylinder.

3 Claims, 3 Drawing Figures

MOUNTING MEANS FOR PLATE CYLINDERS OF A PRINTING MACHINE HAVING REPLACEABLE SLEEVELIKE PLATE CYLINDER SHELLS

BACKGROUND OF THE INVENTION

1. Field of the Invention

The present invention relates to mounting means for plate cylinders of a printing machine, preferably a flexographic printing machine, having replaceable sleevelike plate cylinder shells. More particularly, the present invention relates to structure to permit the rapid removal and replacement of plate cylinder shells without removing the plate cylinder core from the printing machine.

2. Description of the Prior Art

To permit rapid changeover of a flexographic printing machine from one printing job to a new printing job, it is known to provide a tapered plate cylinder core, with a slidably fitted sleevelike plate cylinder shell, so that only the shell is replaced by a new one for a different printing job. For such a replacement of the sleevelike plate cylinder shell, only one bearing of the plate cylinder is removed so that the sleevelike plate cylinder shell can be axially pulled from the plate cylinder core and a new plate cylinder shell can be axially slidably fitted on the core. During such replacement of the shell sleeves it is usually necessary to remove one bearing or to disassemble one bearing to such an extent that the journal of the plate cylinder core carried in the bearing is disengaged from the bearing. A supporting tube is then usually slidably fitted on the plate cylinder core journal and is carried on a bracket so that the plate cylinder core will not fall down, because it is only mounted in a bearing at one end of the cylinder core. The shell sleeve that has been slidably removed from the cylinder core is then initially disposed on the support tube that extends from and supports the plate cylinder core, and the shell sleeve must then be removed from the support tube before the new plate cylinder sleeve can be pushed onto the plate cylinder core. As the shell sleeve is removed from the plate cylinder core and is moved onto the support tube, the plate cylinder core must be held in a substantially horizontal position. That known method of replacing the plate cylinder sleeves is relatively complicated and time-consuming.

In a plate cylinder core mounting arrangement of the kind hereinabove described and disclosed in German Patent Specification No. 891,396, the bearing bracket consists of a conical disc and is held by clamping elements in a complementary conical opening formed in the wall of the machine frame. For this reason the detaching and fixing of the bearing bracket of the known mounting means are relatively time-consuming operations.

It is an object of the present invention to overcome the problems resulting from the known mounting arrangement and to provide a mounting structure that permits a simpler and quicker replacement of the sleevelike plate cylinder shell in a printing machine.

SUMMARY OF THE INVENTION

Briefly stated, in accordance with one aspect of the present invention, apparatus is provided for rotatably mounting a plate cylinder on a printing machine, such as a flexographic printing machine, the machine including replaceable sleevelike plate cylinder shells that are removably carried on a plate cylinder core. The apparatus includes a frame that carries first and second support means that are in laterally spaced relationship and that each include bearing means for rotatably supporting respective ends of the plate cylinder. One of the bearing means, for example the second bearing support means, includes a bearing support bracket. Carriage means are mounted on the frame for movably supporting and carrying the bearing support bracket of the second bearing support means, the carriage means including track means for linearly slidably carrying the bearing support bracket in a direction parallel to the axis of the plate cylinder. Pivotable support means are provided on the frame for pivotably carrying and supporting the track means, and locking means are provided for releasably locking the track means to the frame. The bearing support means is linearly axially movable away from the plate cylinder to withdraw the second bearing means from the plate cylinder and is also pivotable to carry the second bearing means out of axial alignment with the plate cylinder in order to permit a sleevelike plate cylinder shell to be readily applied to and removed from the plate cylinder. Cylinder supporting means are provided and are carried by the frame and positioned adjacent the first bearing means for supporting the plate cylinder in substantially its orientation prior to removal of the second bearing support means while the plate cylinder shell is installed on or removed from the plate cylinder.

DESCRIPTION OF THE PREFERRED EMBODIMENT

Figure 1:
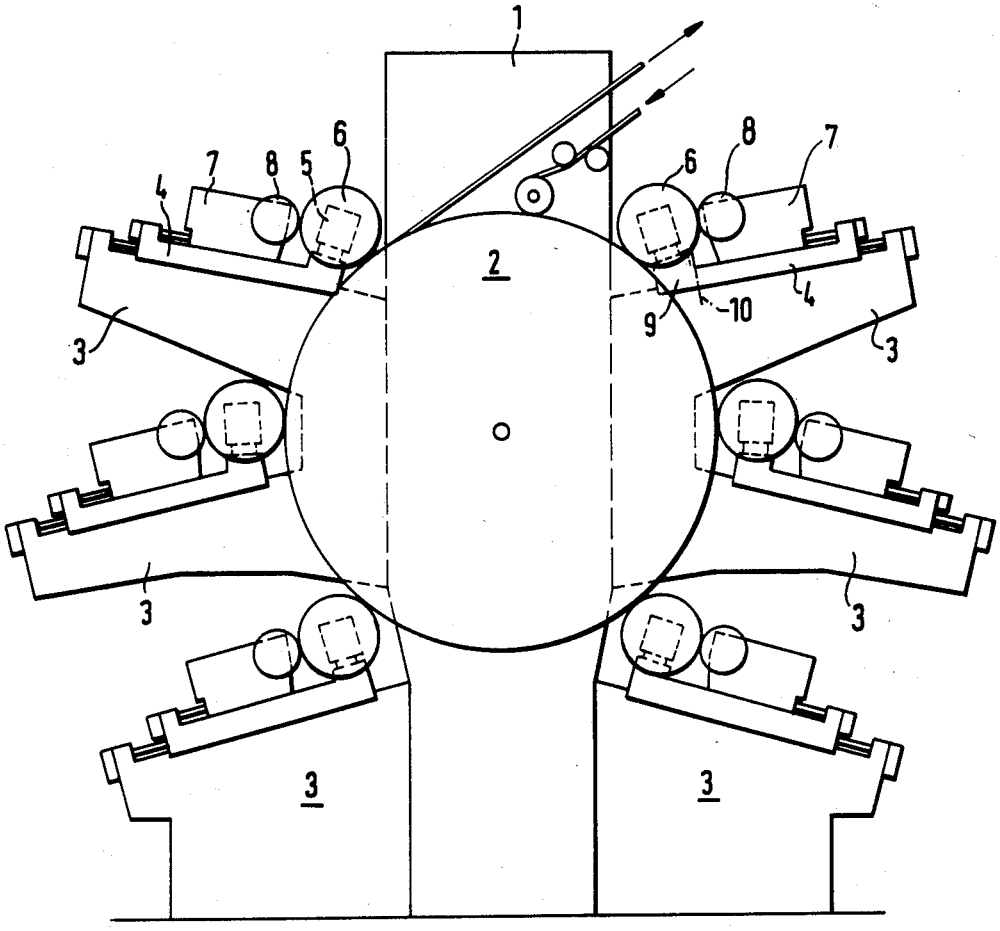
FIG. 1 is a diagrammatic side elevational view of a flexographic printing machine.

Referring now to the drawings, and particularly to FIG. 1 thereof, there is shown an impression cylinder 2 that is rotatably mounted in machine frame 1 of a flexographic printing machine and is provided with suitable cylinder drive means (not shown) to rotate the cylinder about its axis. Machine frame 1 includes a plurality of generally radially extending carrying arms or brackets 3. Respective plate cylinder carriages 4 are supported by and guided on brackets 3 for movement toward and away from impression cylinder 2. Carriages 4 include a pair of spaced bearing brackets 5 (only one of which is visible in dashed line form in FIG. 1) for rotatably supporting a rotatable plate cylinder 6. Plate cylinder carriages 4 are preferably each provided with screws (not shown) for moving respective plate cylinders 6 into and out of engagement with impression cylinder 2.

An ink unit carriage 7 is displaceably carried on and guided by each plate cylinder carriage 4 for movement toward and away from respective plate cylinders 6. Ink unit carriages 7 each include an ink fountain (not shown) and an inking roller 8 that extends into the ink fountain and is rotatably mounted in carriage 7 for engagement with its associated plate cylinder 6.

Plate cylinders 6 are movable toward and away from impression cylinder 2 between printing and non-printing positions by means of piston-cylinder units carried in bearing brackets 5, as will hereinafter be described in connection with FIG. 2. The cylinders of the piston-cylinder units are integrally formed with bearing brackets 5 and are provided with pistons, which carry lip seals, of a structure and in an arrangement such as that described in, for example, German Patent Specification No. 29 41 521. Plate cylinders 6 each include a sleeve-like plate cylinder shell (not shown) that overlies a plate cylinder core, and one bearing bracket 5 in which the plate cylinder 6 is rotatably carried is configured so that the bracket can be withdrawn quickly to permit rapid replacement of the plate cylinder shells. The movable bearing bracket is mounted like a carriage on tracks in a manner which will be described in more detail hereinafter. The tracks are connected to a carrying yoke 9, which extends from and constitutes the forward end portion of plate cylinder carriage 4 and which is pivoted to carriage 4 at a pivot 10 so that the bearing bracket is pivotally movable outwardly from the carriage.

Figure 2:
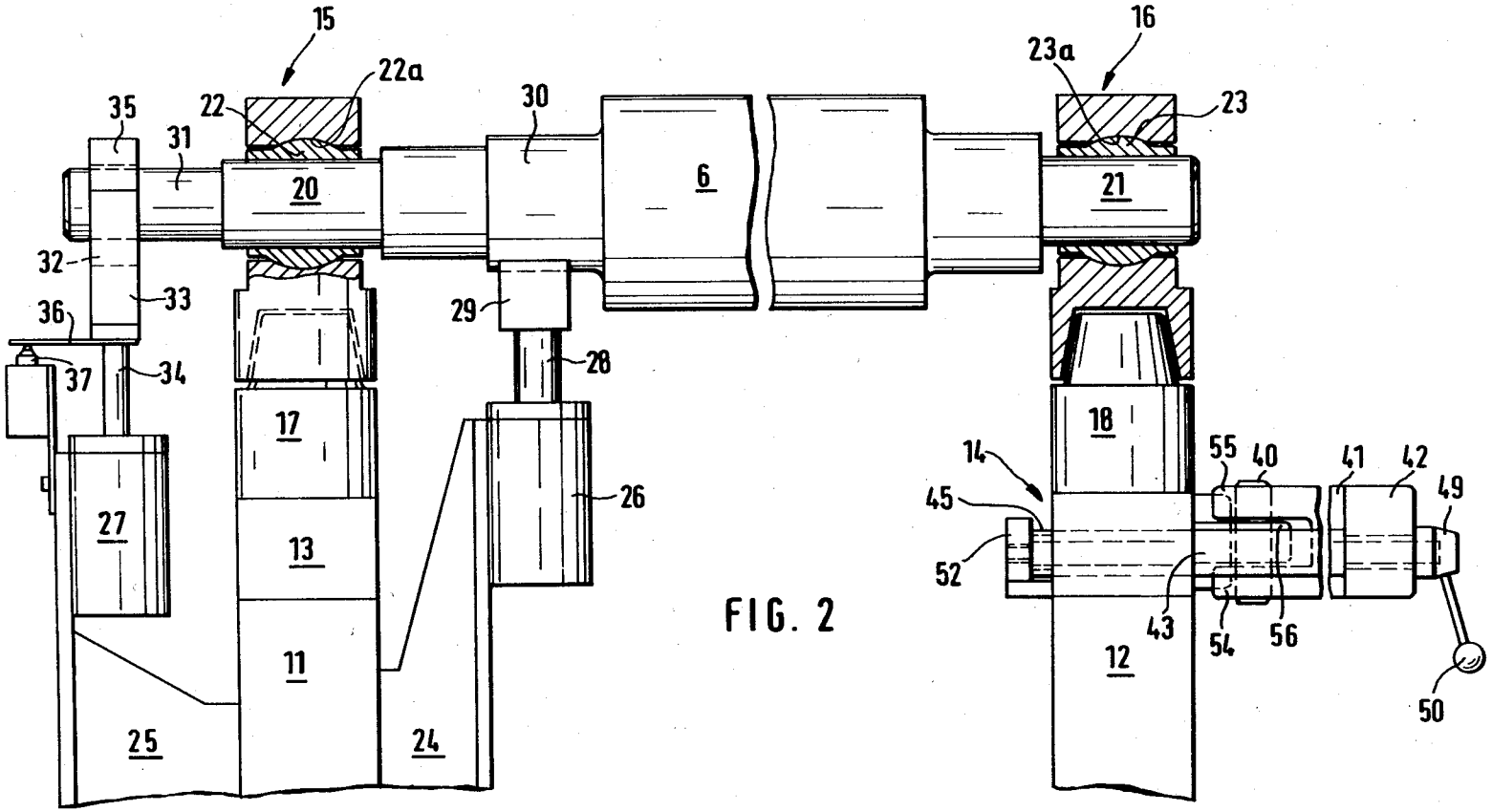
FIG. 2 is a fragmentary side elevational view, partially in section, of a printing machine plate cylinder and supporting structure in accordance with the present invention.

FIG. 2 shows a pair of laterally spaced, upwardly extending legs 11, 12 that are carried on brackets such as brackets 3 shown in FIG. 1. Legs 11, 12 carry respective bearing support brackets 13, 14 for bearing assemblies 15, 16 for each of plate cylinders 6. Fluid-operable piston cylinder units 17, 18 are disposed between bearing support brackets 13, 14 and bearing assemblies 15, 16, respectively, and serve to lift and lower the bearing assemblies 15, 16 to carry plate cylinders 6 to and from their printing and non-printing positions into and out of engagement with the impression cylinder 2 shown in FIG. 1.

Plate cylinder 6 is provided with axially outwardly extending journals 20, 21, which are rotatably carried in sliding surface bearing bushings 22, 23, which are each provided with spherical outside surfaces 22*a*, 23*a*, respectively. Bearing bushings 22, 23 are mounted in corresponding spherical seats carried by bearing brackets 13 and 14.

Leg 11 includes a pair of carrying members 24, 25, secured thereto on the inner and outer sides thereof, respectively, that carry hydraulic piston-cylinder units 26, 27, respectively. Alternatively, carrying members 24, 25 can be secured to plate cylinder carriage 4 (shown in FIG. 1), if desired. Piston rod 28 of piston-cylinder unit 26 carries a supporting trough 29 at its uppermost end, which trough is adapted to support the plate cylinder 6 from below, and to that end is adapted to be raised against an inner, offset thicker portion 30 of journal 20 of plate cylinder 6. An axially outer portion 31 of journal 20 of the plate cylinder 6 of smaller diameter than the portion of journal 20 carried in bearing bushing 22 and is offset therefrom by a step, and extends through an elongate opening 32 formed in a supporting ring 35 that extends from a connecting member 33 connected to and carried on the uppermost end of piston rod 34 of piston-cylinder unit 27. Supporting ring 35 is screw-connected to connecting member 33 and opening 32 surrounds the outer portion 31 of journal 20. Opening 32 is larger in size than outer portion 31 to permit relative vertical movement therebetween. Piston rod 34 can be retracted into its associated cylinder to lower ring 35 to such an extent that the uppermost surface of opening 32 engages and holds down the upper side of outer portion 31 of journal 20. When that holding-down position has been reached, an outwardly extending lever 36 that is connected to piston 34 actuates micro-switch 37 to provide a signal that plate cyinder 6 is in its non-printing position and to uncouple the drive means (not shown) from plate cylinder 6.

Figure 3:
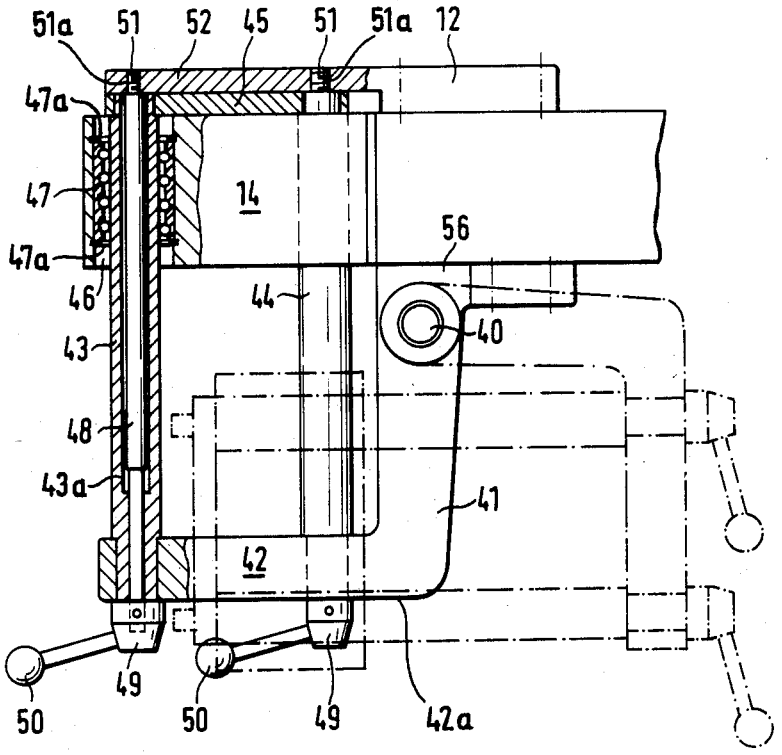
FIG. 3 is a fragmentary top plan view, partially in section, showing a withdrawable plate cylinder supporting structure in accordance with the present invention.

Referring now to both FIGS. 2 and 3, a pivoted yoke 41 consisting of a bell-crank lever is pivotally carried by vertical pivot pin 40, which is carried by leg 12 of the plate cylinder carriage. A pair of tracks are provided and include parallel track rods 43, 44 secured at their outer ends to an oblique leg 42 of yoke 41. The opposite ends of the track rods 43, 44 are interconnected by a crosspiece 45. Bearing bracket 14 for bearing assembly 16 is displaceable along and guided by track rods 43, 44 and is provided with two spaced, parallel bores 46, only one of which is visible in FIG. 3, each of which bores contains a linear ball bearing 47, which is axially held by suitable spaced clamp rings 47*a* and carries one of track rods 43, 44 for axial movement therewith.

Track rods 43, 44 are tubular and include axial bores (only axial bore 43*a* is visible in FIG. 3). Rods 48 extend within and through the bores in track rods 43, 44 and are provided at their outermost ends with heads 49, which bear on the outside surface 42*a* of leg 42 of pivoted yoke 41 and each head includes a handle 50. The innermost end portions of each of bolts 48 are provided with external screw threads 51, which are adapted to be threadedly received in internally threaded bores 51*a* provided in wall portion 52 of leg 12 of the plate cylinder carriage.

Referring once again to FIG. 2, pivoted yoke 41 includes two forked bearing legs 54, 55 which are on respective sides of pivot support 56 that extends laterally outwardly from leg 12 and carries pivot pin 40.

FIG. 3 shown in phantom the pivoted yoke 41 and the track rods 43, 44 in their swung-out position, after rods 48 have been unthreaded from wall portion 52.

In operation, for replacing a sleevelike plate cylinder shell, the supporting trough 29 and support ring 35 of connecting member 33 are initially moved in opposite directions to their respective cylinder-engaging positions, which are shown in FIG. 2. In those positions, the plate cylinder 6 is held only at the portions 30, 31 of the left-hand journal so that the plate cylinder 6 will be held in position even when bearing assembly 16 has been withdrawn. The lower surface of inner portion 30 is supported on supporting trough 29 and the upper surface of outer portion 31 is supported by the upper surface of opening 32 in ring 35 to provide support and to offset the moment that would otherwise cause plate cylinder 6 to pivot clockwise about bearing assembly 15 when opposite bearing assembly 16 is removed and no longer supports plate cylinder 6.

To remove bearing assembly 16 from plate cylinder 6, a locking means (not shown) for connecting the bearing support bracket 14 to leg 12 of the plate cylinder carriage 4 is released. After that release, bearing bushings 23 of bearing assembly 16 are loosened, if required, and bearing assembly 16 can then be axially withdrawn from the right-hand journal 21 by an axial movement of the bearing support bracket 14, which is moved axially outwardly along track rods 43, 44 to such an extent that it is adjacent to the leg 42 of the pivoted yoke 41. By means of the handles 50, the rods 48 are then rotated until they have been unscrewed from wall portion 52 of leg 12. In that position the pivoted yoke 41, together with bearing support bracket 14, piston-cylinder unit 18 and bearing assembly 16, can be pivotally moved to the position shown in phantom in FIG. 3. When those elements are in that position relative to the axis of plate cylinder 6, the sleevelike plate cylinder shell can be readily withdrawn from the core of plate cylinder 6 and can be replaced by another plate cylinder shell, while plate cylinder 6 is supported by supporting ring 35 and supporting trough 29.

Although a particular embodiment of the present invention has been illustrated and described, it will be apparent to those skilled in the art that various changes and modifications can be made without departing from the spirit of the present invention. It is therefore intended to cover in the appended claims all such changes and modifications that fall within the scope of the present invention.

What is claimed is:

1. Apparatus for rotatably mounting plate cylinders on a printing machine, the plate cylinders including replaceable sleevelike plate cylinder shells removably carried on the plate cylinders, said apparatus comprising:

(a) a frame;

(b) first and second bearing support means carried on said frame in laterally spaced relationship and including bearing means for rotatably supporting respective ends of a plate cylinder, said second bearing support means including a bearing support bracket;

(c) carriage means mounted on said frame for removably supporting and carrying said bearing support bracket, said carriage means including track means for linearly slidably carrying said bearing support bracket in a direction parallel to the axis of the plate cylinder, pivotable support means pivotally carried by said frame for supporting said track means, and locking means for releasably locking said track means to said frame, said bearing support means being linearly axially movable away from the plate cylinder to withdraw said second bearing support means from the plate cylinder and being pivotable to carry said second bearing support means out of axial alignment with the plate cylinder to permit a sleevelike plate cylinder shell to be applied to and removed from the plate cylinder; and (d) cylinder supporting means carried by said frame and positioned adjacent said first bearing means for supporting the plate cylinder in substantially its orientation prior to removal of said second bearing support means while a plate cylinder shell is being removed from or installed on the plate cylinder, wherein said cylinder supporting means includes hydraulic piston-cylinder means positioned on each side of said first bearing means, said piston-cylinder means each including piston rod means to carry respective supporting members that contact and support the plate cylinder on respective upper and lower sides thereof to prevent pivotal movement of the plate cylinder about said first bearing means.

2. Apparatus in accordance with claim 1, wherein one of said piston-cylinder means includes an upwardly facing supporting trough that is engageable with the lower surface of an end of the plate cylinder at a point on one side of said first bearing support means, and the other of said piston-cylinder units includes a downwardly-facing supporting member that is engageable with the uper surface of an end of the plate cylinder at a point on the opposite side of said first bearing support means.

3. Apparatus for rotatably mounting plate cylinders on a printing machine, the plate cylinders including replaceable sleevelike plate cylinder shells removably carried on the plate cylinders, said apparatus comprising:

(a) a frame;

(b) first and second bearing support means carried on said frame in laterally spaced relationship and including bearing means for rotatably supporting respective ends of a plate cylinder, said second bearing support means including a bearing support bracket;

(c) carriage means mounted on said frame for removably supporting and carrying said bearing support bracket, said carriage means including track means for linearly slidably carrying said bearing support bracket in a direction parallel to the axis of the plate cylinder, pivotable support means pivotally carried by said frame for supporting said track means, and locking means for releasably locking said track means to said frame, said bearing support means being linearly axially movable away from the plate cylinder to withdraw said second bearing support means from the plate cylinder and being pivotable to carry said second bearing support means out of axial alignment with the plate cylinder to permit a sleevelike plate cylinder shell to be applied to and removed from the plate cylinder; and (d) cylinder supporting means carried by said frame and positioned adjacent said first bearing means for supporting the plate cylinder in substantially its orientation prior to removal of said second bearing support means while a plate cylinder shell is being removed from or installed on the plate cylinder, wherein said track means includes a pair of spaced, parallel track rods and said bearing bracket carries a pair of linear ball bearings that are movable along said track rods, and wherein said track rods are tubular and include inner axial bores, and said locking means includes a pair of rods carried in respective ones of said bores, one end of each of said rods threadedly engageable with said frame to releasably lock said rods thereto, and the other ends of said rods include rotation means to permit rotation of said rods relative to said frame.

* * * * *